US010174484B2

(12) United States Patent
Joo

(10) Patent No.: US 10,174,484 B2
(45) Date of Patent: Jan. 8, 2019

(54) CONTROL CIRCUIT AND CONTROL METHOD FOR BOOM ENERGY REGENERATION

(71) Applicant: Doosan Infracore Co., Ltd., Incheon (KR)

(72) Inventor: Choon Shik Joo, Gyeonggi-do (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 246 days.

(21) Appl. No.: 15/103,447

(22) PCT Filed: Dec. 17, 2014

(86) PCT No.: PCT/KR2014/012440

§ 371 (c)(1),
(2) Date: Jun. 10, 2016

(87) PCT Pub. No.: WO2015/099353

PCT Pub. Date: Jul. 2, 2015

(65) Prior Publication Data

US 2016/0312444 A1 Oct. 27, 2016

(30) Foreign Application Priority Data

Dec. 26, 2013 (KR) ..... 10-2013-0163938

(51) Int. Cl.
*F15B 11/02* (2006.01)
*E02F 9/22* (2006.01)
(Continued)

(52) U.S. Cl.
CPC ..... *E02F 9/2217* (2013.01); *B66C 13/20* (2013.01); *E02F 3/435* (2013.01); *E02F 9/2292* (2013.01);
(Continued)

(58) Field of Classification Search
CPC ..... E02F 9/2217; F15B 21/14; F15B 11/024
See application file for complete search history.

(56) References Cited

U.S. PATENT DOCUMENTS 6,725,581 B2 * 4/2004 Naruse ..... E02F 9/2217 37/348
7,905,088 B2 * 3/2011 Stephenson ..... E02F 9/2217 60/414
(Continued)

FOREIGN PATENT DOCUMENTS

DE 102011008709 7/2012
EP 2589823 5/2013
(Continued)

OTHER PUBLICATIONS

International Search Report (with English translation) issued in international application No. PCT/KR2014/012440, dated Mar. 10, 2015, 7 pages.
(Continued)

*Primary Examiner* — Thomas E Lazo
(74) *Attorney, Agent, or Firm* — K&L Gates LLP

(57) ABSTRACT

The present disclosure relates to a control circuit and a control method for boom energy regeneration, and the control circuit for boom energy regeneration includes: a control unit which controls a discharge amount control valve, such that the amount of oil, which is discharged from a head of a boom cylinder, is supplied to a regeneration device or a rod of the boom cylinder through a hydraulic regeneration line, and when the regeneration device has an abnormality, the amount of oil, which is discharged from the head of the boom cylinder, is supplied to the main control valve through a hydraulic discharge line.

18 Claims, 7 Drawing Sheets

(51) Int. Cl.

| | |
|---|---|
| ***E02F 3/43*** | (2006.01) |
| ***E02F 9/26*** | (2006.01) |
| ***B66C 13/20*** | (2006.01) |
| ***F15B 11/024*** | (2006.01) |
| ***F15B 1/027*** | (2006.01) |
| ***F15B 1/04*** | (2006.01) |
| ***F15B 11/08*** | (2006.01) |
| ***F15B 13/044*** | (2006.01) |

(52) U.S. Cl.

CPC ..... *E02F 9/2296* (2013.01); *E02F 9/268* (2013.01); *F15B 1/027* (2013.01); *F15B 1/04* (2013.01); *F15B 11/024* (2013.01); *F15B 11/08* (2013.01); *F15B 13/044* (2013.01); *F15B 2211/2053* (2013.01); *F15B 2211/3058* (2013.01); *F15B 2211/70* (2013.01)

(56) References Cited

U.S. PATENT DOCUMENTS

| | | | | |
|---|---|---|---|---|
| 9,228,323 | B2 * | 1/2016 | Kawasaki | E02F 9/2217 |
| 2008/0110166 | A1 | 5/2008 | Stephenson et al. | |
| 2013/0318955 | A1 * | 12/2013 | Zhang | E02F 9/2217 60/413 |
| 2014/0090367 | A1 * | 4/2014 | Hijikata | E02F 9/2091 60/414 |
| 2014/0245729 | A1 * | 9/2014 | Nanjo | E02F 9/226 60/414 |

FOREIGN PATENT DOCUMENTS

| | | | | |
|---|---|---|---|---|
| EP | 2963191 | | | 1/2016 |
| JP | 2012-092546 | A | | 5/2012 |
| JP | 2012092546 | A | * | 5/2012 |
| JP | 2012-237123 | A | | 12/2012 |
| JP | 2013-002540 | A | | 1/2013 |
| JP | 2013002540 | A | * | 1/2013 |
| JP | 2013-087831 | A | | 5/2013 |
| KR | 10-2013-0092380 | A | | 8/2013 |

OTHER PUBLICATIONS

Written Opinion issued in international application No. PCT/KR2014/012440, dated Mar. 10, 2015, 9 pages.

Extended European Search Report issued in European Patent Application No. 14874059.0 dated Sep. 29, 2017.

* cited by examiner

CONTROL CIRCUIT AND CONTROL METHOD FOR BOOM ENERGY REGENERATION

CROSS REFERENCE TO RELATED APPLICATIONS

The present application is a National Stage of International Application No. PCT/KR2014/012440, filed on Dec. 17, 2014, which claims priority to Korean Patent Application No. 10-2013-0163938, filed on Dec. 26, 2013, the entire contents of each of which are being incorporated herein by reference.

FIELD OF THE DISCLOSURE

The present disclosure relates to a control circuit and a control method for boom energy regeneration, and more particularly, to a control circuit and a control method for boom energy regeneration, which are capable of normally operating a boom even in a case in which boom energy regeneration devices have an abnormality.

BACKGROUND OF THE DISCLOSURE

In general, as illustrated in FIG. 1, in the case of an excavator as a construction machine, an upper turning body 13 of a main body 10 is rotatably installed by a turning motor in a state in which a turning bearing 12 is disposed between the upper turning body 13 and a lower traveling body 11 of the main body 10.

A power device 14, a cabin 15, and a front working device 16 are mounted at a front side of the upper turning body 13 of the main body 10, the front working device 16 is pivotally attached to the upper turning body 13 so that a boom 17 may be freely rotated in an up and down direction, an arm 18 is freely rotatably and pivotally connected to the boom 17, and a bucket 19 is freely rotatably and pivotally connected to the arm 18.

Further, the boom 17 is rotated in the up and down direction by a boom cylinder 17*c*, the arm 18 is rotated by an arm cylinder 18*c*, and the bucket 19 is rotated by a bucket cylinder 19*c*. A fluid for operating the respective cylinders is oil, that is, hydraulic oil.

Meanwhile, a regeneration control valve block 20, which is provided with a plurality of valves that constitute an energy regeneration system for regenerating boom energy released from the boom cylinder 17*c* when the front working device 16 is lowered, is attached to a lower rear surface of the boom 17.

In the case of the boom energy regeneration control system, when the boom 17, which has been raised, is lowered when the front working device 16 moves vertically, hydraulic oil at high pressure is discharged from a head of the boom cylinder 17*c* by potential energy of the boom 17.

Because the hydraulic oil becomes useless if the hydraulic oil discharged at high pressure returns to a tank as it is, the hydraulic oil discharged at high pressure from the head of the boom cylinder 17*c* is accumulated in regeneration devices such as an accumulator, or used to rotate a separate hydraulic motor to supplement output from an engine, thereby reducing fuel consumption of the engine. In a case in which the excavator performs any load work, the hydraulic oil accumulated in the accumulator is discharged, thereby effectively utilizing potential energy of the boom 17.

However, there is a problem in that in a case in which some of the regeneration devices, which constitute the boom energy regeneration control system, have an abnormality and thus cannot be normally operated, the boom cylinder cannot be normally operated when the boom is lowered, which causes inconvenience for an operator.

SUMMARY

An embodiment of the present disclosure has been made in an effort to solve the aforementioned problem, and to provide a control circuit and a control method for boom energy regeneration, which are capable of normally operating a boom cylinder when a boom is lowered even in a case in which some of the regeneration devices, which constitute a boom energy regeneration system, have an abnormality and thus cannot be normally operated.

Technical problems to be solved by the present disclosure are not limited to the aforementioned technical problem, and other technical problems, which are not mentioned above, may be clearly understood from the following descriptions by those skilled in the art to which the present disclosure pertains.

To achieve the aforementioned object, the present disclosure provides a control circuit for boom energy regeneration, including: a boom cylinder which operates a boom of a construction machine; a regeneration device which regenerates energy of the boom cylinder; a hydraulic regeneration line which connects the boom cylinder and the regeneration device; a discharge amount control valve which is provided on the hydraulic regeneration line, a hydraulic discharge line which branches off from the hydraulic regeneration line at a front of the discharge amount control valve and is connected to a main control valve; and a control unit which controls the discharge amount control valve, such that the amount of oil, which is discharged from a head of the boom cylinder, is supplied to the regeneration device or a rod of the boom cylinder through the hydraulic regeneration line, and when the regeneration device has an abnormality, the amount of oil, which is discharged from the head of the boom cylinder, is supplied to the main control valve through the hydraulic discharge line.

Further, the control circuit for boom energy regeneration may further include a first EPPR valve which is provided between the discharge amount control valve and the control unit, and controls an opening degree of the discharge amount control valve using pressure in accordance with a magnitude of voltage applied from the control unit.

Further, the control circuit for boom energy regeneration may further include a bypass valve which is provided between the main control valve and an operating unit for manipulating the boom, in which the bypass valve blocks control pressure generated by the operating unit, and when the regeneration device has an abnormality, the bypass valve transmits control pressure generated by the operating unit to the main control valve.

In addition, the control unit may control whether to shut off the bypass valve.

Further, the control circuit for boom energy regeneration may further include a check valve which is provided on the hydraulic regeneration line so as to be disposed at a front of a branching point of the hydraulic discharge line.

In addition, the first EPPR valve may control an opening degree of the check valve using pressure in accordance with a magnitude of voltage applied from the control unit.

In addition, the first EPPR valve may open both of the discharge amount control valve and the check valve when pressure of a pressure value or higher which is predetermined by the control unit is present, and the first EPPR valve may open only the check valve when pressure below a pressure value which is predetermined by the control unit is produced.

Further, the control circuit for boom energy regeneration may further include a second EPPR valve which is provided between the check valve and the control unit, and controls an opening degree of the check valve using pressure in accordance with a magnitude of voltage applied from the control unit.

In addition, the first EPPR valve and the second EPPR valve may control opening degrees of the discharge amount control valve and the check valve, respectively, using pressure in accordance with a magnitude of voltage applied from the control unit.

In addition, the regeneration device may include: a hydraulic motor which is connected to a driving shaft of an engine; and an accumulator which accumulates the amount of oil discharged from the head of the boom cylinder or the amount of oil discharged from the hydraulic motor.

Meanwhile, to achieve the aforementioned object, the present disclosure provides a control method for boom energy regeneration, including: determining whether an accumulator and a hydraulic motor, which regenerate energy of a boom cylinder for operating a boom of a construction machine, are normally operated; and controlling a bypass valve provided between a main control valve and an operating unit for manipulating the boom so as to transmit control pressure generated by the operating unit to the main control valve, and to supply the main control valve with the amount of oil discharged from a head of the boom cylinder at the same time as an operation of lowering the boom, when it is determined that at least one of the accumulator and the hydraulic motor is erroneously operated as the result of the normal operation determination.

In addition, when it is determined that both of the accumulator and the hydraulic motor are normally operated as a result of the normal operation determination, the bypass valve may block control pressure generated by the operating unit and supply the accumulator and the hydraulic motor with the amount of oil discharged from the head of the boom cylinder.

In addition, when the amount of oil, which is discharged from the head of the boom cylinder, is supplied to the main control valve, a discharge amount control valve, which is provided on a hydraulic regeneration line that connects the accumulator and the hydraulic motor with the boom cylinder, may be closed, such that the amount of oil is supplied to the main control valve through a hydraulic discharge line that branches off from the hydraulic regeneration line.

In addition, when the amount of oil, which is discharged from the head of the boom cylinder, is supplied to the accumulator and the hydraulic motor, a discharge amount control valve, which is provided on a hydraulic regeneration line that connects the accumulator and the hydraulic motor with the boom cylinder, may be opened, such that the amount of oil is supplied to the accumulator and the hydraulic motor through the hydraulic regeneration line.

In addition, when the amount of oil, which is discharged from the head of the boom cylinder, is supplied to the main control valve, only a discharge amount control valve between a check valve and the discharge amount control valve, which are provided on a hydraulic regeneration line that connects the accumulator and the hydraulic motor with the boom cylinder, may be closed, such that the amount of oil is supplied to the main control valve through a hydraulic discharge line that branches off from the hydraulic regeneration line.

In addition, when the amount of oil, which is discharged from the head of the boom cylinder, is supplied to the accumulator and the hydraulic motor, both of a check valve and a discharge amount control valve, which are provided on a hydraulic regeneration line that connects the accumulator and the hydraulic motor with the boom cylinder, may be opened, such that the amount of oil is supplied to the accumulator and the hydraulic motor through the hydraulic regeneration line.

In addition, opening degrees of the discharge amount control valve and the check valve may be controlled by a first EPPR valve, and the first EPPR valve may open both of the discharge amount control valve and the check valve when pressure of a predetermined pressure value or higher is present, and may open only the check valve when pressure below a predetermined pressure value is present.

In addition, opening degrees of the discharge amount control valve and the check valve may be controlled by a first EPPR valve and a second EPPR valve, respectively.

According to the present disclosure, even in a case in which some of the regeneration devices, which constitute a boom energy regeneration system, have an abnormality and thus cannot be normally operated, the boom cylinder may be normally operated when the boom is lowered, thereby eliminating inconvenience to an operator.

DESCRIPTION OF MAIN REFERENCE NUMERALS OF THE DRAWINGS

Figure 1:
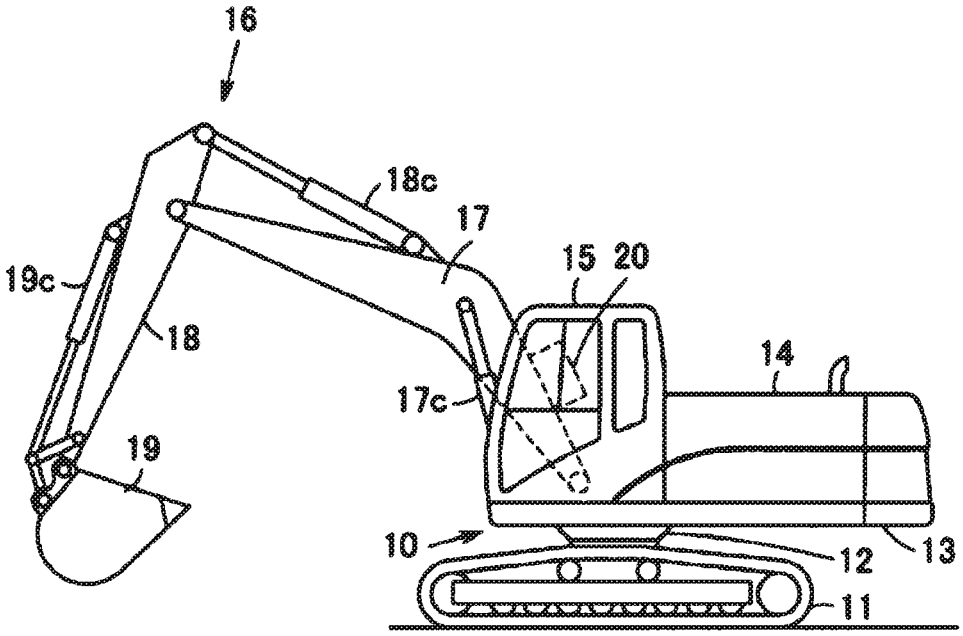
FIG. 1 (Prior Art)
FIG. 1 is a side view of a construction machine having a typical boom energy regeneration system.

100: Boom cylinder
112: Hydraulic motor
114: Accumulator
120: Hydraulic regeneration line
130: Discharge amount control valve
140: Hydraulic discharge line
150: Main control valve
160: Control unit
170: Pressure compensation valve
180: check valve
191: First EPPR valve
192: Second EPPR valve
200: Bypass valve
210: Operating unit
300: Oil supplementing unit

DETAILED DESCRIPTION

Hereinafter, an exemplary embodiment according to the present disclosure will be described in detail with reference to the accompanying drawings. Here, sizes, shapes, or the like of constituent elements illustrated in the drawings may be exaggerated for clarity and convenience of description. In addition, terms, which are especially defined considering configurations and operations of the present disclosure, may vary depending on the intention or usual practice of a user or an operator. The definition of the terms should be made based on the entire contents of the present specification. Further, the spirit of the present disclosure is not limited to the disclosed exemplary embodiment, and those skilled in the art, who understand the spirit of the present disclosure, may easily carry out other exemplary embodiments within a range of the same spirit, and the other exemplary embodiments also of course belong to the scope of the present disclosure.

Figure 2:
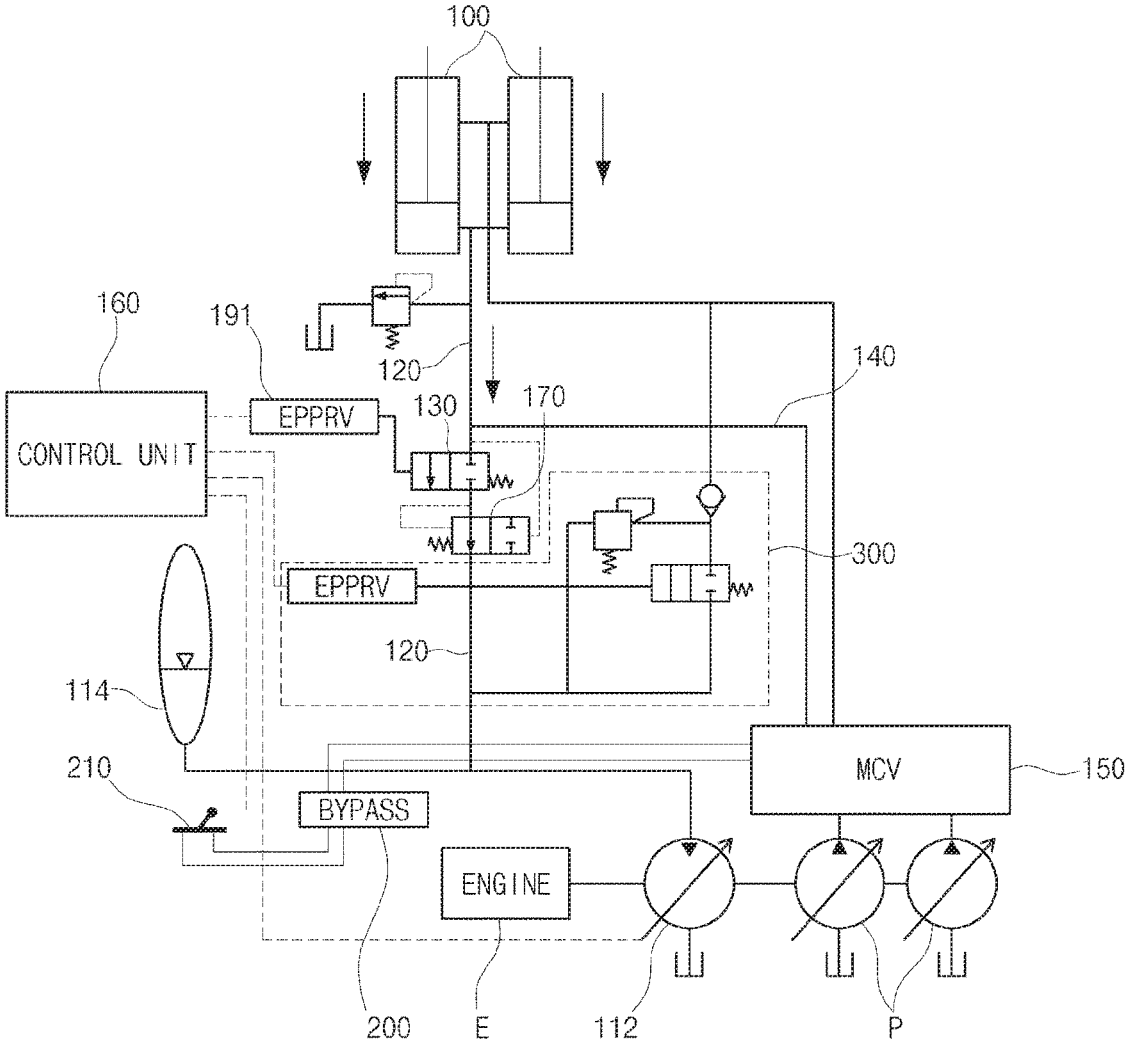
FIG. 2 is a hydraulic circuit diagram illustrating a control circuit for boom energy regeneration according to a first exemplary embodiment of the present disclosure.

FIG. 2 is a hydraulic circuit diagram illustrating a control circuit for boom energy regeneration according to a first exemplary embodiment of the present disclosure. A configuration of the control circuit for boom energy regeneration will be described in detail with reference to FIG. 2.

The control circuit for boom energy regeneration serves to normally operate a boom cylinder when a boom is lowered even in a case in which some of the regeneration devices, which constitute a boom energy regeneration system, have an abnormality and thus cannot be normally operated, and the control circuit for boom energy regeneration includes a boom cylinder 100, the regeneration devices, a hydraulic regeneration line 120, a discharge amount control valve 130, a hydraulic discharge line 140, a control unit 160, a first EPPR valve 191, a bypass valve 200, and the like.

The boom cylinder 100 is an actuator for operating a boom of a construction machine, and reciprocally moves by hydraulic oil supplied or discharged from a head and a rod.

The regeneration devices are devices for regenerating energy using hydraulic oil discharged from the head of the boom cylinder 100 in a case in which the hydraulic oil is discharged from the head of the boom cylinder 100 and supplied to the rod, that is, when the boom cylinder 100 is lowered, and the regeneration devices include a hydraulic motor 112 and an accumulator 114.

That is, the hydraulic oil, which is discharged from the head of the boom cylinder 100 when the boom cylinder 100 is lowered, is accumulated in the accumulator 114 and then supplied to the hydraulic motor 112, or supplied directly to the hydraulic motor 112, thereby operating the hydraulic motor 112 to assist driving power of an engine E.

The hydraulic regeneration line 120 connects the boom cylinder 100 and the regeneration devices. As illustrated in FIG. 2, one end of the hydraulic regeneration line 120 is connected to the head of the boom cylinder 100, and the other end of the hydraulic regeneration line 120 is divided and then connected to the hydraulic motor 112 and the accumulator 114.

The discharge amount control valve 130 is provided on the hydraulic regeneration line 120, and operated when the boom cylinder 100 is lowered to regenerate the boom energy, thereby opening the hydraulic regeneration line 120.

The hydraulic discharge line 140 branches off from the hydraulic regeneration line 120 at a front of the discharge amount control valve 130 and is connected to a main control valve 150, and the main control valve 150 operates a spool so as to supply the boom cylinder 100 with hydraulic oil discharged from a main hydraulic pump P or to be supplied with the amount of oil discharged from the boom cylinder 100.

The control unit 160 controls the first EPPR valve 191 and the bypass valve 200, and particularly, the first EPPR valve 191 is an electromagnetic proportional control valve and is provided between the control unit 160 and the discharge amount control valve 130 in order to control an opening degree of the discharge amount control valve 130 using pressure in accordance with a magnitude of voltage applied from the control unit 160.

Further, the bypass valve 200 is provided between the main control valve 150 and an operating unit 210 such as a boom joystick for manipulating the boom, and the control unit 160 controls whether to shut off control pressure generated by the operating unit 210.

Meanwhile, a pressure compensation valve 170, which is provided at a rear of the discharge amount control valve 130, receives a pressure signal from the front and rear of the discharge amount control valve 130, and adjusts an opening degree using a difference between the two pressure values, thereby constantly controlling pressure of hydraulic oil that flows through the hydraulic regeneration line 120.

In addition, an oil supplementing unit 300, which includes an electromagnetic proportional control valve, a relief valve, an openable valve, and a check valve, supplies the rod of the boom cylinder 100 with the amount of oil that is insufficient due to an area difference between the head and the rod of the boom cylinder 100 when the boom is lowered.

According to the first exemplary embodiment of the present disclosure which has the aforementioned configurations, the amount of oil, which is discharged from the head of the boom cylinder 100 so as to regenerate boom energy when the boom is lowered, is supplied to the regeneration device such as the hydraulic motor 112 or the accumulator 114 through the hydraulic regeneration line 120.

In this case, the first EPPR valve 191 operates the discharge amount control valve 130 to open the hydraulic regeneration line 120 by being controlled by the control unit 160, and the bypass valve 200 is shut off by being controlled by the control unit 160 in order to prevent pressure generated by the operating unit 210 from being transmitted to the main control valve 150.

That is, the hydraulic regeneration line 120 allows the head of the boom cylinder 100 to communicate with the regeneration devices, and a flow path of the main control valve 150 is shut off as the spool in the main control valve 150 does not operate. Therefore, the operation of lowering the boom and the boom energy regeneration process are carried out at the same time.

In contrast, in a case in which the regeneration devices have an abnormality such as a case in which a swash plate angle of the hydraulic motor 112 is abnormally controlled or the accumulator 114 is out of a normal working pressure range, the amount of oil, which is discharged from the head of the boom cylinder 100, is supplied to the main control valve 150 through the hydraulic discharge line 140.

In this case, the first EPPR valve 191 closes the discharge amount control valve 130 to shut off the hydraulic regeneration line 120 by being controlled by the control unit 160, and the bypass valve 200 is opened by being controlled by the control unit 160 so as to allow pressure generated by the operating unit 210 to be transmitted to the main control valve 150.

That is, the hydraulic regeneration line 120 allows the head of the boom cylinder 100 and the regeneration devices to be blocked from each other, and the flow path of the main control valve 150 is opened as the spool in the main control valve 150 operates. Therefore, even in a case in which the regeneration devices have an abnormality and thus the boom energy regeneration process is not carried out, the operation of lowering the boom is normally carried out.

According to the present disclosure, even in a case in which some or all of the regeneration devices, which constitute the boom energy regeneration system, have an abnormality and cannot be normally operated, the boom cylinder 100 may be normally operated when the boom is lowered, thereby eliminating inconvenience to an operator.

Figure 3:
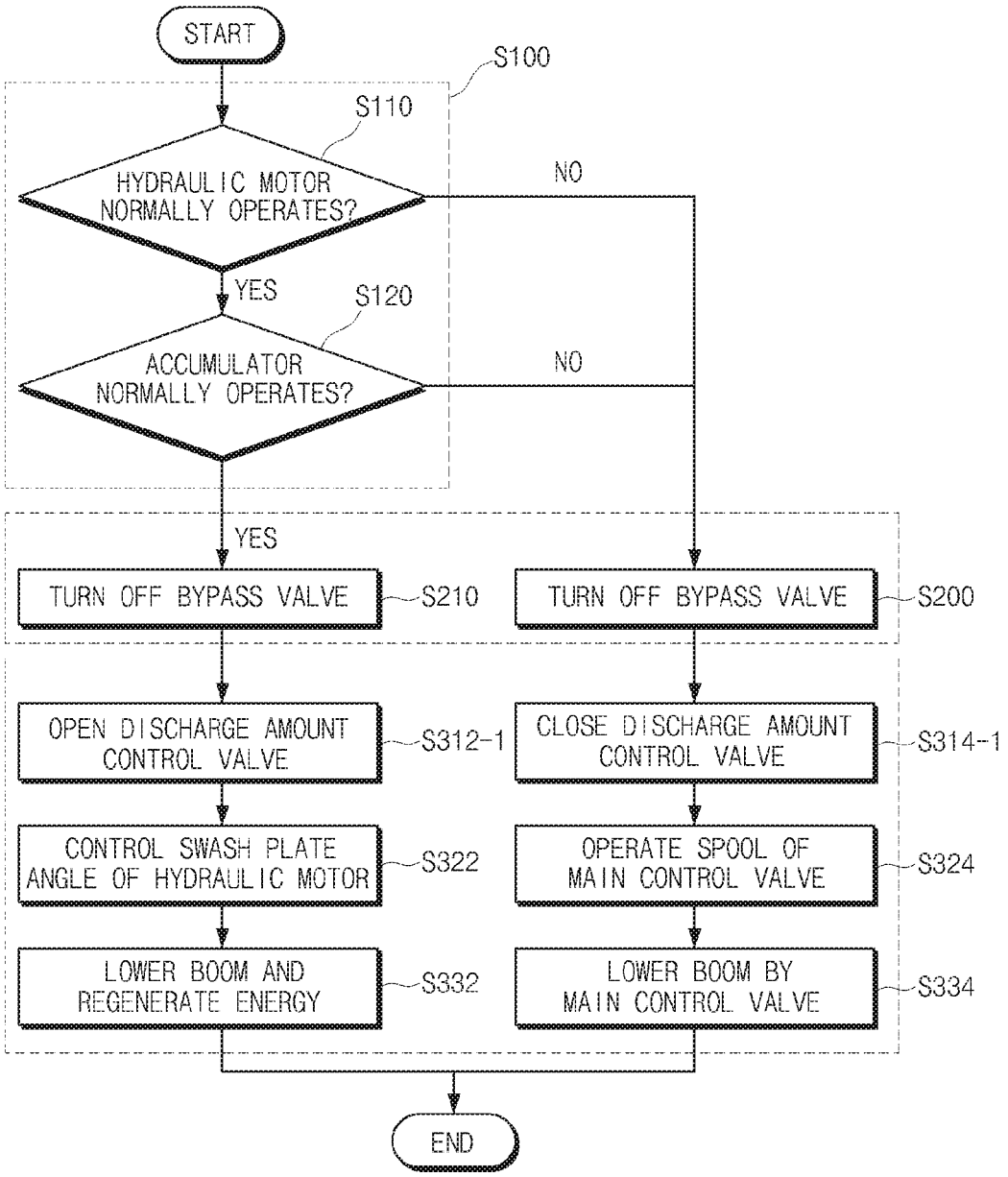
FIG. 3 is a flowchart illustrating a control method for boom energy regeneration according to the first exemplary embodiment of the present disclosure.

FIG. 3 is a flowchart illustrating a control method for boom energy regeneration according to the first exemplary embodiment of the present disclosure. The control method for boom energy regeneration will be described in detail with reference to FIG. 3.

The control method for boom energy regeneration includes a regeneration determination step S100, a bypass valve control step S200, and a flow path decision step S300, and serves to normally operate the boom cylinder 100 when the boom is lowered even in a case in which some or all of the regeneration devices, which constitute the boom energy regeneration system, have an abnormality and cannot be normally operated, as described above.

The regeneration determination step S100 is a step of determining whether the hydraulic motor 112 and the accumulator 114, which are the regeneration devices for regenerating energy of the boom cylinder 100 for operating the boom, are normally operated, and determines whether a malfunction occurs, such as whether a swash plate angle of the hydraulic motor 112 is abnormally controlled or whether the accumulator 114 is out of the normal working pressure range (S110 and S120).

The bypass valve control step S200 is a step of controlling the bypass valve 200 provided between the main control valve 150 and the operating unit 210 for manipulating the boom, and in this case, the control unit 160 controls whether to allow the bypass valve 200 to transmit control pressure generated by the operating unit 210 to the main control valve 150 or to block the control pressure.

The flow path decision step S300 is a step of deciding a flow direction of the amount of oil discharged from the head of the boom cylinder 100 at the same time as the operation of lowering the boom, and changes the flow direction of the amount of oil so as to supply the amount of oil to the regeneration device when the regeneration device is normally operated, but to supply the amount of oil to the main control valve 150 when the regeneration device is erroneously operated.

According to the first exemplary embodiment of the present disclosure which has the aforementioned configurations, in a case in which it is determined that the hydraulic motor 112 is normally operated (S110) and it is determined that the accumulator 114 is normally operated (S120) in the regeneration determination step S100, the bypass valve 200 blocks control pressure generated by the operating unit 210 from being transmitted to the main control valve 150 (S210) in the bypass valve control step S200.

Further, in the flow path decision step S300, the amount of oil discharged from the head of the boom cylinder 100 is supplied to the regeneration device, that is, to the hydraulic motor 112 and the accumulator 114.

That is, the discharge amount control valve 130, which is provided on the hydraulic regeneration line 120 that connects the boom cylinder 100 and the regeneration device, is operated to be opened (S312-1), such that the amount of oil is supplied to the regeneration device through the hydraulic regeneration line 120.

For example, a swash plate angle of the hydraulic motor 112 is controlled by the control unit 160 so as to assist driving power of the engine E, and the accumulator 114 accumulates the amount of inflow oil and then supplies the oil to the hydraulic motor 112 and the like as necessary (S322).

In a case in which all of the regeneration devices are normally operated as described above, the amount of oil discharged from the head of the boom cylinder 100 is supplied to the hydraulic motor 112 and the accumulator 114, such that the boom energy regeneration is carried out at the same time as the operation of lowering the boom (S332).

In contrast, in a case in which it is determined that the hydraulic motor 112 is erroneously operated (S110), or it is determined that the accumulator 114 is erroneously operated (S120), that is, it is determined that at least one of the regeneration devices is erroneously operated in the regeneration determination step S100, the bypass valve 200 transmits control pressure generated by the operating unit 210 to the main control valve 150 in the bypass valve control step S200.

Further, in the flow path decision step S300, the amount of oil discharged from the head of the boom cylinder 100 is supplied to the main control valve 150.

That is, the discharge amount control valve 130 is maintained in a closed state (S314-1), such that the amount of oil is supplied to the main control valve 150 through the hydraulic discharge line 140 that branches off from the hydraulic regeneration line 120.

In this case, the main control valve 150 operates the spool in the main control valve 150 by receiving control pressure generated by the operating unit 210, and opens the flow path that connects the boom cylinder 100 and the main hydraulic pump P (S324).

In a case in which some or all of the regeneration devices are erroneously operated as described above, the amount of oil, which is discharged from the head of the boom cylinder 100, is not transmitted to the regeneration devices but supplied to the main control valve 150, such that the operation of lowering the boom is normally carried out although the boom energy regeneration cannot be carried out (S334).

That is, according to the present disclosure as described above, even in a case in which some or all of the regeneration devices, which constitute the boom energy regeneration system, have an abnormality and cannot be normally operated, the boom cylinder 100 may be normally operated when the boom is lowered, thereby eliminating inconvenience to an operator.

Figure 4:
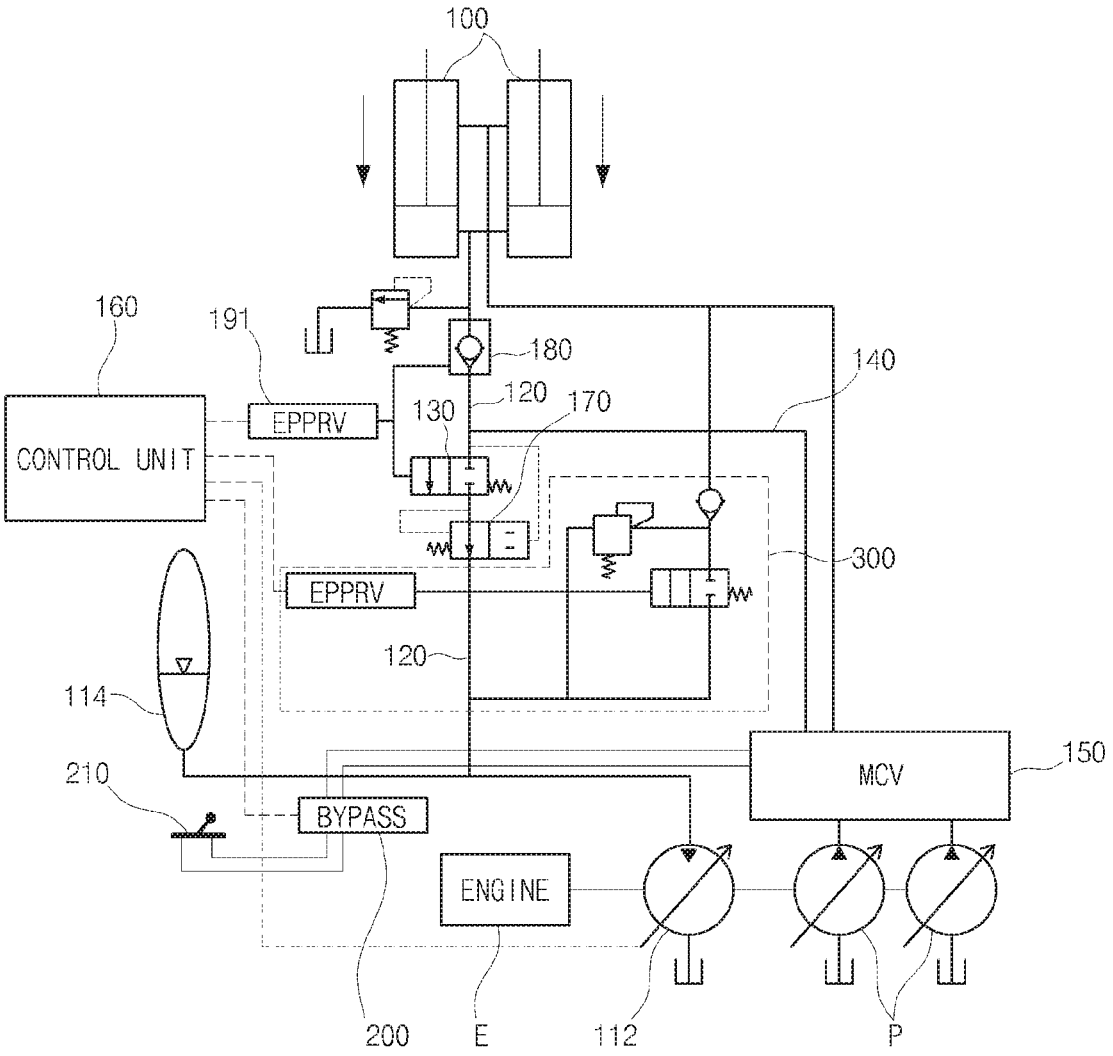
FIG. 4 is a hydraulic circuit diagram illustrating a control circuit for boom energy regeneration according to a second exemplary embodiment of the present disclosure.
Figure 5:
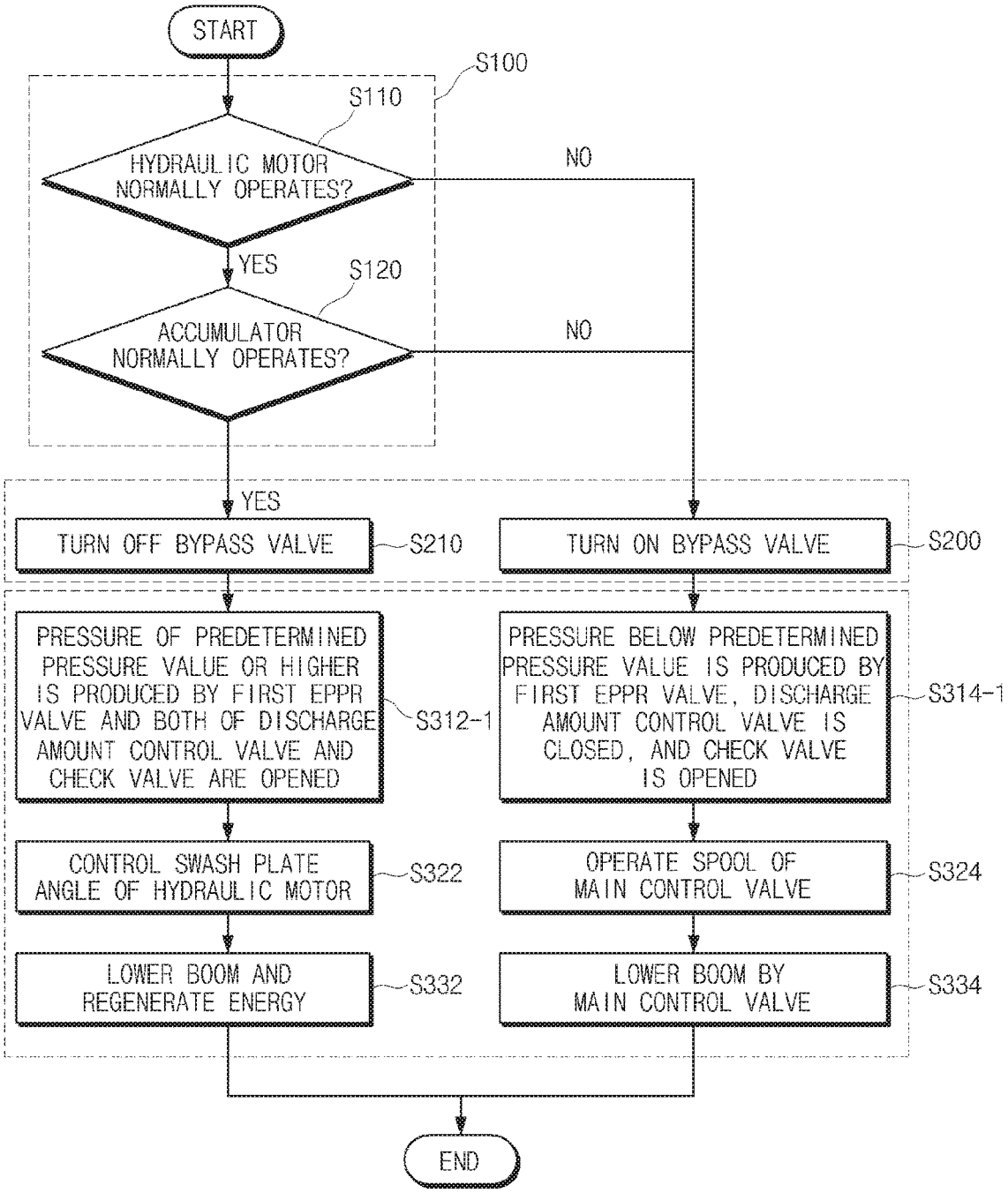
FIG. 5 is a flowchart illustrating a control method for boom energy regeneration according to the second exemplary embodiment of the present disclosure.

FIG. 4 is a hydraulic circuit diagram illustrating a control circuit for boom energy regeneration according to a second exemplary embodiment of the present disclosure, and FIG. 5 is a flowchart illustrating a control method for boom energy regeneration according to the second exemplary embodiment of the present disclosure.

A configuration of the control circuit for boom energy regeneration and the control method for boom energy regeneration will be described in detail with reference to FIGS. 4 and 5, but descriptions of the configuration and the control method, which are identical to the configuration of the control circuit for boom energy regeneration and the control method for boom energy regeneration according the first exemplary embodiment, will be omitted.

A check valve 180 is further provided in the control circuit for boom energy regeneration, and the check valve 180 is provided on the hydraulic regeneration line 120 so as to be disposed at a front of a branching point of the hydraulic discharge line 140 in order to hold the boom, and an opening degree of the check valve 180 is controlled by the first EPPR valve 191.

Further, cracking pressure of the check valve 180 is set such that both of the discharge amount control valve 130 and the check valve 180 are opened when the first EPPR valve 191 produces pressure of a predetermined pressure value or higher, and the discharge amount control valve 130 is shut off and only the check valve 180 is opened when the first EPPR valve 191 produces pressure below a predetermined pressure value.

For example, in a case in which a reference pressure value for opening and separation is predetermined as 10 bar by the control unit 160, the cracking pressure of the check valve 180 may be set such that both of the discharge amount control valve 130 and the check valve 180 may be opened when the first EPPR valve 191 produces pressure of 10 bar or higher, and only the check valve 180 may be opened when the first EPPR valve 191 produces pressure below 10 bar.

Therefore, in a case in which all of the regeneration devices are normally operated in the control method for boom energy regeneration, the first EPPR valve 191 opens both of the check valve 180 and the discharge amount control valve 130 (S312-2) in the flow path decision step S300, such that the amount of oil, which is discharged from the head of the boom cylinder 100, is supplied to the regeneration devices, that is, the hydraulic motor 112 and the accumulator 114 through the hydraulic regeneration line 120.

In contrast, in a case in which some or all of the regeneration devices are erroneously operated in the control method for boom energy regeneration, the first EPPR valve 191 opens the check valve 180 and simultaneously, maintains the closed state of the discharge amount control valve 130 (S314-2) in the flow path decision step S300, such that the amount of oil, which is discharged from the head of the boom cylinder 100, is supplied to the main control valve 150 through the hydraulic discharge line 140 that branches off from the hydraulic regeneration line 120.

Figure 6:
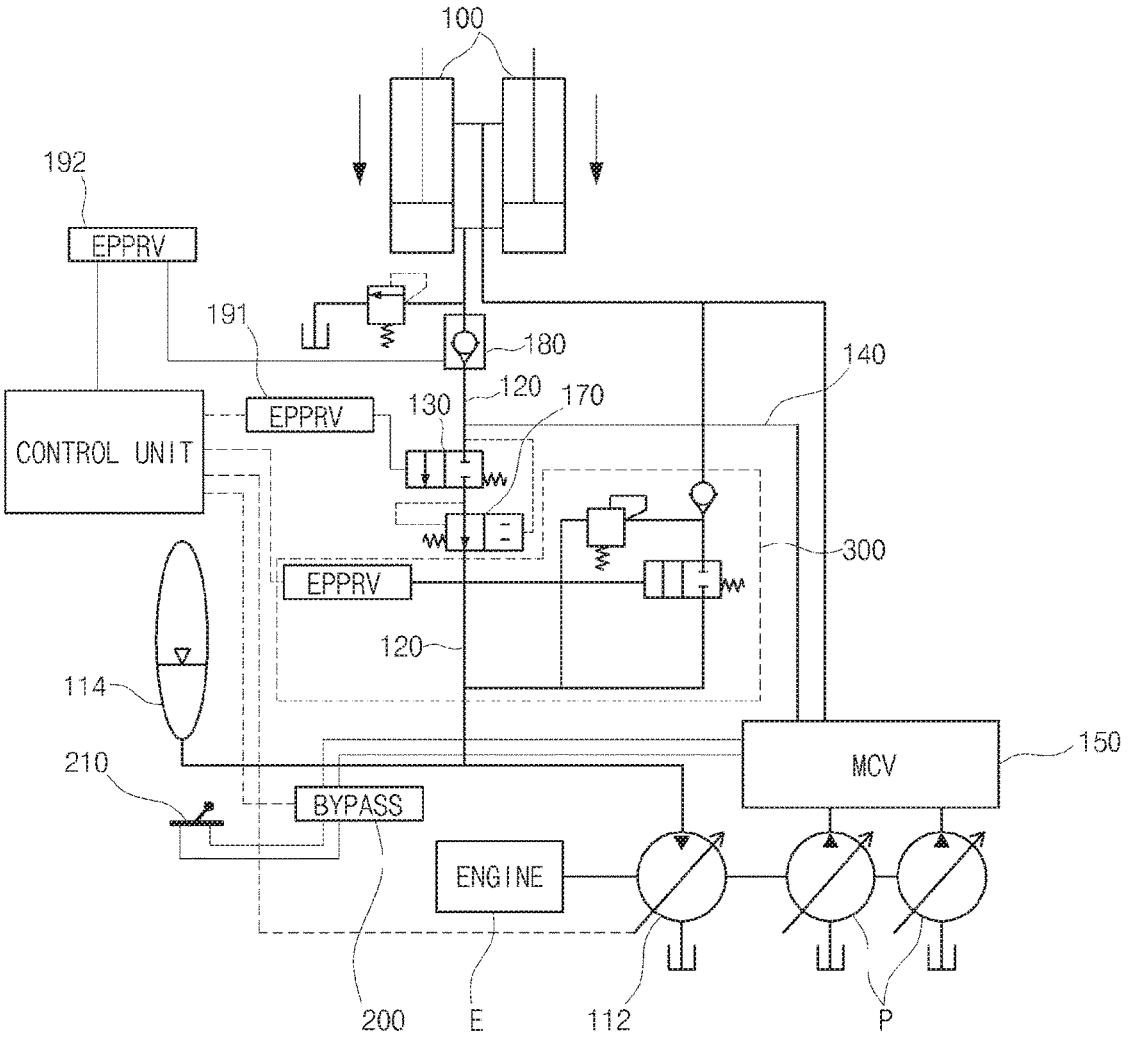
FIG. 6 is a hydraulic circuit diagram illustrating a control circuit for boom energy regeneration according to a third exemplary embodiment of the present disclosure.
Figure 7:
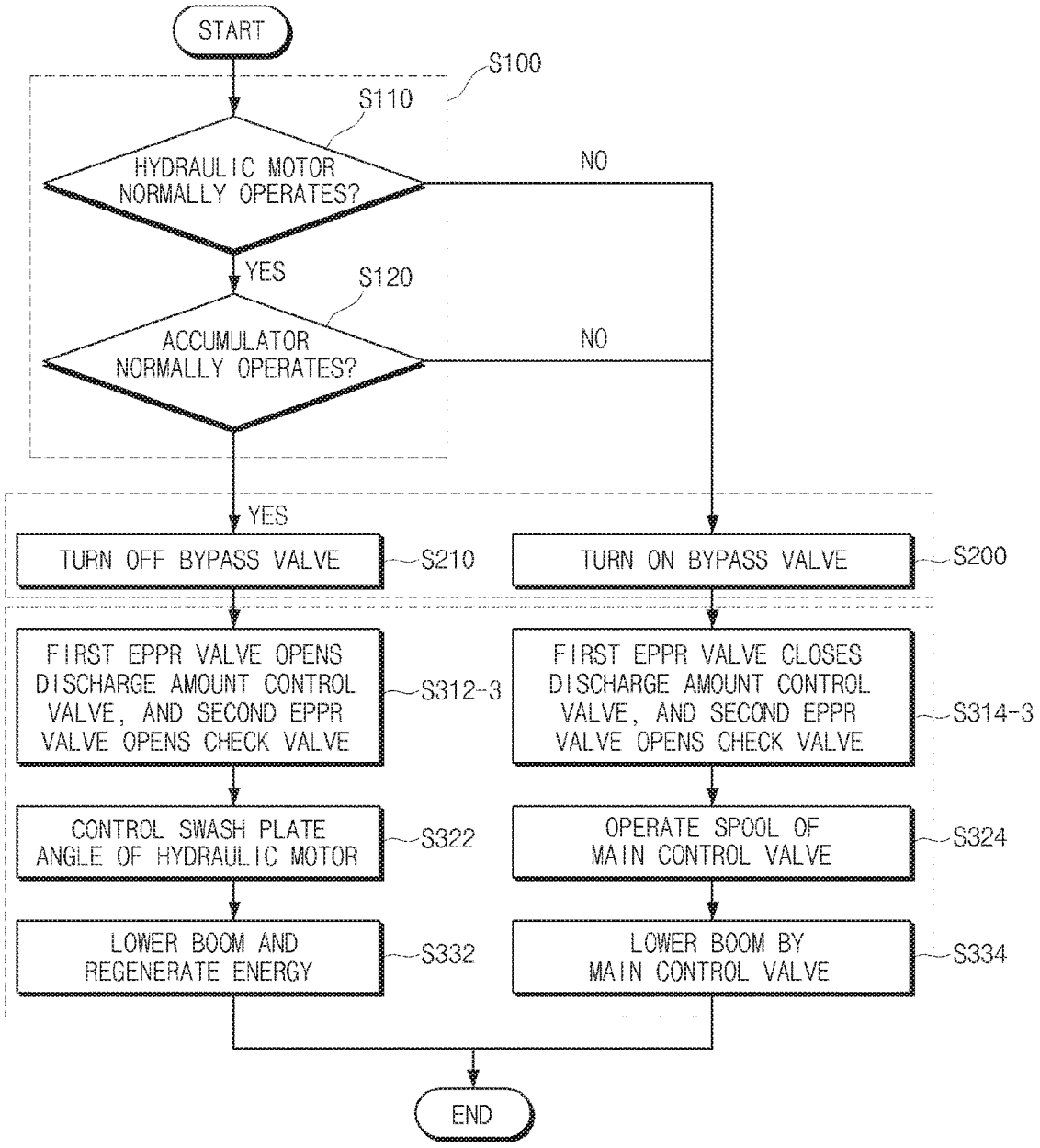
FIG. 7 is a flowchart illustrating a control method for boom energy regeneration according to the third exemplary embodiment of the present disclosure.

FIG. 6 is a hydraulic circuit diagram illustrating a control circuit for boom energy regeneration according to a third exemplary embodiment of the present disclosure, and FIG. 7 is a flowchart illustrating a control method for boom energy regeneration according to the third exemplary embodiment of the present disclosure.

A configuration of the control circuit for boom energy regeneration and the control method for boom energy regeneration will be described in detail with reference to FIGS. 6 and 7, but descriptions of the configuration and the control method, which are identical to the configurations of the control circuits for boom energy regeneration and the control methods for boom energy regeneration according the first and second exemplary embodiments, will be omitted.

A second EPPR valve 192 is further provided in the control circuit for boom energy regeneration, and the second EPPR valve 192 is provided between the check valve 180 and the control unit 160, and controls an opening degree of the check valve 180 using pressure in accordance with a magnitude of voltage applied from the control unit 160.

That is, according to the third exemplary embodiment of the present disclosure, the discharge amount control valve 130 is controlled by the first EPPR valve 191, and the check valve 180 is controlled by the second EPPR valve 192, such that the discharge amount control valve 130 and the check valve 180 are independently controlled.

Therefore, in a case in which all of the regeneration devices are normally operated in the control method for boom energy regeneration, the second EPPR valve 192 opens the check valve 180 and the first EPPR valve 191 opens the discharge amount control valve 130 (S312-3) in the flow path decision step S300, such that the amount of oil, which is discharged from the head of the boom cylinder 100, is supplied to the regeneration devices, that is, the hydraulic motor 112 and the accumulator 114 through the hydraulic regeneration line 120.

In contrast, in a case in which some or all of the regeneration devices are erroneously operated in the control method for boom energy regeneration, the second EPPR valve 192 opens the check valve 180 and the first EPPR valve 191 maintains the closed state of the discharge amount control valve 130 (S314-3) in the flow path decision step S300, such that the amount of oil, which is discharged from the head of the boom cylinder 100, is supplied to the main control valve 150 through the hydraulic discharge line 140 that branches off from the hydraulic regeneration line 120.

While the exemplary embodiments of the present disclosure have been described above, the exemplary embodiments are described just for illustration, and those skilled in the art will understand that various modifications of the exemplary embodiments and any other exemplary embodiment equivalent thereto are available. Accordingly, the true technical protection scope of the present disclosure should be determined by the appended claims.

What is claimed is:

1. A control circuit for boom energy regeneration, comprising:

a boom cylinder configured to operate a boom of a construction machine;

a regeneration device configured to regenerate energy of the boom cylinder;

a hydraulic regeneration line configured to connect the boom cylinder and the regeneration device;

a discharge amount control valve provided on the hydraulic regeneration line;

a hydraulic discharge line branching off from the hydraulic regeneration line at a front of the discharge amount control valve and is connected to a main control valve; and a control unit configured to control the discharge amount control valve, such that an amount of oil discharged from a head of the boom cylinder is supplied to the regeneration device or a rod of the boom cylinder through the hydraulic regeneration line, and when the regeneration device has an abnormality, the amount of oil discharged from the head of the boom cylinder is supplied to the main control valve through the hydraulic discharge line, wherein the regeneration device includes:

a hydraulic motor connected to a driving shaft of an engine, wherein the hydraulic motor is configured to provide a rotational force to a hydraulic pump; and an accumulator configured to accumulate the amount of oil discharged from the head of the boom cylinder or an amount of oil discharged from the hydraulic motor, wherein one end of the hydraulic regeneration line is connected to the head of the boom cylinder, and the other end of the hydraulic regeneration line is diverged to be connected to the hydraulic motor and the accumulator, respectively.

2. The control circuit of claim 1, further comprising:

a first EPPR valve configured to control an opening degree of the discharge amount control valve by producing pressure in accordance with a magnitude of voltage applied from the control unit.

3. The control circuit of claim 2, further comprising:

a check valve provided on the hydraulic regeneration line so as to be disposed at a front of a branching point of the hydraulic discharge line.

4. The control circuit of claim 3, wherein an opening degree of the check valve is controlled by the first EPPR valve which produces pressure in accordance with a magnitude of voltage applied from the control unit.

5. The control circuit of claim 4, wherein the first EPPR valve is configured to:

open both of the discharge amount control valve and the check valve when pressure of a pressure value or higher which is predetermined by the control unit is produced; and open only the check valve when pressure below the predetermined pressure value is produced.

6. The control circuit of claim 3, further comprising:

a second EPPR valve provided between the check valve and the control unit, wherein the second EPPR valve is configured to control an opening degree of the check valve by producing pressure in accordance with a magnitude of voltage applied from the control unit.

7. The control circuit of claim 1, further comprising:

a bypass valve provided between the main control valve and an operating unit for manipulating the boom, wherein the bypass valve blocks control pressure generated by the operating unit, and when the regeneration device has an abnormality, the bypass valve transmits control pressure generated by the operating unit to the main control valve.

8. The control circuit of claim 7, wherein the control unit controls whether to shut off the bypass valve.

9. A control method for boom energy regeneration, comprising:

determining whether an accumulator and a hydraulic motor, which regenerate energy of a boom cylinder for operating a boom of a construction machine, are normally operated, wherein the hydraulic motor is connected to a driving shaft of an engine and is configured to provide a rotational force to a hydraulic pump, and the accumulator is connected to a head of the boom cylinder and the hydraulic motor through a hydraulic regeneration line to accumulate an amount of oil discharged from the head of the boom cylinder or an amount of oil discharged from the hydraulic motor; and controlling a bypass valve provided between a main control valve and an operating unit for manipulating the boom so as to transmit control pressure generated by the operating unit to the main control valve, and to supply the main control valve with the amount of oil discharged from the head of the boom cylinder at the same time as an operation of lowering the boom, when it is determined that at least one of the accumulator and the hydraulic motor is erroneously operated.

10. The control method of claim 9, wherein when it is determined that both of the accumulator and the hydraulic motor are normally operated, the bypass valve blocks control pressure generated by the operating unit and supplies the accumulator and the hydraulic motor with the amount of oil discharged from the head of the boom cylinder.

11. The control method of claim 10, wherein when the amount of oil, which is discharged from the head of the boom cylinder, is supplied to the accumulator and the hydraulic motor, a discharge amount control valve, which is provided on a hydraulic regeneration line that connects the accumulator and the hydraulic motor with the boom cylinder, is opened, such that the amount of oil is supplied to the accumulator and the hydraulic motor through the hydraulic regeneration line.

12. The control method of claim 10, wherein when the amount of oil, which is discharged from the head of the boom cylinder, is supplied to the accumulator and the hydraulic motor, both of a check valve and a discharge amount control valve, which are provided on a hydraulic regeneration line that connects the accumulator and the hydraulic motor with the boom cylinder, are opened, such that the amount of oil is supplied to the accumulator and the hydraulic motor through the hydraulic regeneration line.

13. The control method of claim 12, wherein opening degrees of the discharge amount control valve and the check valve are controlled by a first EPPR valve, and the first EPPR valve opens both of the discharge amount control valve and the check valve when pressure of a predetermined pressure value or higher is produced, and opens only the check valve when pressure below the predetermined pressure value is produced.

14. The control method of claim 12, wherein opening degrees of the discharge amount control valve and the check valve are controlled by a first EPPR valve and a second EPPR valve, respectively.

15. The control method of claim 9, wherein when the amount of oil, which is discharged from the head of the boom cylinder, is supplied to the main control valve, a discharge amount control valve, which is provided on a hydraulic regeneration line that connects the accumulator and the hydraulic motor with the boom cylinder, is closed, such that the amount of oil is supplied to the main control valve through a hydraulic discharge line that branches off from the hydraulic regeneration line.

16. The control method of claim 9, wherein when the amount of oil, which is discharged from the head of the boom cylinder, is supplied to the main control valve, only a discharge amount control valve provided on a hydraulic regeneration line that connects the accumulator and the hydraulic motor with the boom cylinder, is closed while a check valve is open, such that the amount of oil is supplied to the main control valve through a hydraulic discharge line that branches off from the hydraulic regeneration line.

17. The control method of claim 16, wherein opening degrees of the discharge amount control valve and the check valve are controlled by a first EPPR valve, and the first EPPR valve opens both of the discharge amount control valve and the check valve when pressure of a predetermined pressure value or higher is produced, and opens only the check valve when pressure below the predetermined pressure value is produced.

18. The control method of claim 16, wherein opening degrees of the discharge amount control valve and the check valve are controlled by a first EPPR valve and a second EPPR valve, respectively.

* * * * *